US005273206A

United States Patent [19]

Vassiliou

[11] Patent Number: 5,273,206

[45] Date of Patent: Dec. 28, 1993

[54] DISPOSABLE BOX BY DESTRUCTIVE FOLDING

[75] Inventor: Eustathios Vassiliou, Newark, Del.

[73] Assignee: WTPA, Incorporated, Newark, Del.

[21] Appl. No.: 963,689

[22] Filed: Oct. 20, 1992

Related U.S. Application Data

[63] Continuation-in-part of Ser. No. 917,159, Jul. 9, 1992, Pat. No. 5,197,659.

[51] Int. Cl.[5] ..... B65D 5/36; B65D 5/42

[52] U.S. Cl. ..... 229/117.01; 229/117.05; 229/906; 229/930; 229/931

[58] Field of Search ..... 229/117.01, 117.05, 229/117.06, 902, 903, 906, 917, DIG. 2, DIG. 4; 426/113-115

[56] References Cited

U.S. PATENT DOCUMENTS

| | | | |
|---|---|---|---|
| 664,835 | 1/1901 | Czarniecki | 229/117.01 |
| 2,037,675 | 4/1936 | Boothby et al. | 229/117.01 |
| 2,189,436 | 7/1938 | Rosenfield | 229/4.5 |
| 2,244,940 | 6/1941 | Carruth | 229/5.5 |
| 2,671,593 | 3/1954 | Page | 229/5.7 |
| 2,807,405 | 9/1957 | Lambert | 229/41 |
| 2,845,976 | 8/1958 | Miller | 150/52 |
| 3,473,723 | 10/1969 | Bolling, Jr. et al. | 229/117.01 |
| 4,228,918 | 10/1980 | Kellogg | 221/65 |
| 4,365,738 | 12/1982 | Densen | 229/117.01 |
| 5,040,721 | 8/1991 | Essak | 229/112 |
| 5,110,038 | 5/1992 | Pantisano | 229/103 |
| 5,197,659 | 3/1993 | Vassiliou | 229/906 |

FOREIGN PATENT DOCUMENTS

| | | | |
|---|---|---|---|
| 1302573 | 7/1962 | France | 229/117.05 |

*Primary Examiner*—Gary E. Elkins
*Attorney, Agent, or Firm*—E. Vassiliou

[57] ABSTRACT

A foldable box having, in addition to primary folding lines and flat segments, a number of latent destructive lines in a direction perpendicular to the length of the unfolded box. The latent destructive lines do not interfere with the formation and the normal function of the box. However, they serve to facilitate an irreversible destruction of the box, when the box is forced to be folded into a log-like structure.

14 Claims, 6 Drawing Sheets

DISPOSABLE BOX BY DESTRUCTIVE FOLDING

This is a continuation-in-part of U.S. patent application Ser. No. 07/917,159 filed on Jul. 9, 1992, now U.S. Pat. No. 5,197,659, which is incorporated herein by reference.

1. FIELD OF THE INVENTION

This invention relates to foldable boxes, and more particularly to boxes which may be easily disposed of by destructive folding.

2. BACKGROUND OF THE INVENTION

There is a plethora of box types existing in the marketplace, such as for example those with small or large dimensions, re-usable or disposable, thin or thick, composite or single-ply structured, rigid or flexible, foldable or non-foldable, and the like.

In order to reduce cost of manufacturing, transportation, manipulation by a middle- or end-user, as well as other costs, foldable boxes are becoming increasingly popular. For the same reasons, monolithic (one piece) unfolded boxes containing primary folding lines are provided to retailers, who fold them on demand to enclose an item to be sold to the consumer.

Some of these boxes are easy to dispose of, because they may be either small, or flexible, and the like. However, there is a category of boxes, which have large and/or awkward dimensions and high rigidity, with large flat segments both before and after the box formation, which present considerable difficulty in bending and further folding for disposal. A representative type of such boxes, which are difficult to discard, are the pizza boxes. These boxes come usually in a monolithic form to the pizza-House or establishment, and they are folded around primary folding lines to form boxes having very large flat segments. These boxes are of different shapes, such as for example square, hexagonal, octagonal, and the like. The primary folding lines may be perforations, indentations, slits, cuts, or any other weakening lines, or configurations, very well known to the art of box formation. These lines provide weakening of the integrity of the unfolded box along their length, so that the unfolded box can be shaped around the weakening lines. No good way has been suggested so far by the art for utilizing folding lines on the large flat segments of the box for the purpose of future destruction of the box by folding. Therefore, there is a strong need for a mechanism on the flat segments, which does not interfere with the formation of the box or with the function of the box during its useful life, but which mechanism may be activated at will and provide means for easy destruction of the box for disposal.

U.S. Pat. Nos. 2,189,436 (Rosenfield), 2,244,940 (Carruth), 2,671,593 (Page), 2,807,405 (Lambert), and 4,228,918 (Kellogg), disclose boxes which are characterized by a large multiplicity of primary fold lines which are positioned in a way to form substantially curved configurations, like for example substantially circular side wall structures.

U.S. Pat. No. 2,845,976 (Miller) discloses a collapsible roll-up container with a series of flat members each formed with a tendency to coil. The spring structure of this box, however, is expensive to make and it does not provide adequate rigidity for end-uses such as pizza boxes, and the like.

U.S. Pat. No. 5,040,721 (Essak) discloses a collapsible box with a stiffening insert.

U.S. Pat. No. 5,110,038 (Pantisano) discloses a standard corrugated pizza box which is provided with slit-cuts cut through the top panel of the pizza box in a shape to cut off four circular serving plates with a beveled raised edge and two cross-slit cuts through the bottom panel of the pizza box separating the pizza box into four essentially equal portions for disposal. Pantisano's arrangement is based on tearing the box apart, and it does not provide the simple folding operation offered by the present invention, wherein there are latent destructive folding lines perpendicular to the longitudinal axis of the box and parallel to each other.

U.S. Pat. Nos. 664 835 (Czarniecki), 2,037,675 (Boothby et al.), 3,473,723 (Bolling, Jr. et al) and 4,365,738 (Densen), as well as French Patent 1,302,573 show various collapsible boxes.

None of the above references or any other reference known to Applicant disclose, mention or suggest a foldable box as described and claimed hereinbelow.

3. SUMMARY OF THE INVENTION

The instant invention is directed to foldable boxes, and more particularly to boxes which may be easily disposed of by destructive folding. In summary, the invention pertains a foldable box-blank comprising:

- a first end, a second end, and a longitude having a direction from the first end toward the second end;
- a top segment, a bottom segment and side segments, which top-, bottom-, and side segments remain substantially flat in both a folded and unfolded form of the box-blank;
- a plurality of primary folding lines serving to allow an operator to form a box from the box-blank by folding the flat segments around respective primary folding lines;
- plurality of latent destructive lines on at least part of at least one flat segment selected from the group consisting of the top segment and the bottom segment, the latent destructive lines having
  - a direction substantially perpendicular to the longitudinal direction of the box-blank, and
  - an effective degree of higher resistance to folding than the primary folding lines, so that they present no interference with
    - the formation of the box, and
    - the flatness of the flat segments before and after the box formation; and
    - allow irreversible destruction of the box by the operator through first unfolding the box to its box-blank configuration and then folding the box-blank around the late nt destructive lines to form a log-like structure.

The resistance to folding of the latent destructive lines is preferably at least 20% higher than the resistance to folding of the primary folding lines. Also, the intervals between consecutive latent destructive lines are preferably between 1 and 10 cm.

The latent destructive lines may be located in the vicinity of at least one of said ends, and in most occasions, only 4 latent destructive lines are adequate to provide the advantages of the present invention.

In one embodiment, each of the folding lines and each of the latent destructive lines independently comprise consecutive fragments selected from the group comprising perforations, indentations, scores, and a combination thereof. In a different embodiment.

the fragments of the folding lines are characterized by a first length and a first separation; and the fragments of the latent destructive lines are characterized by a second length and a second separation; and the ratio of the second separation to the second length is at least 20% larger than the ratio of the first separation to the first length.

The top and the bottom segments are preferably monolithic and more preferably, the top segment and the bottom segment have substantially equal surface areas. It is also preferable that the surface area of the top segment is at least three times as large as the surface area of the largest-in-area side segment.

The box-blank may also comprise corrugations having preferably a direction parallel to the direction of the longitude of the box-blank.

This invention is also directed to a box having a folded and an unfolded form, the box comprising a box-blank also having a folded and an unfolded form, which forms are identical to the folded and the unfolded form of the box, respectively, the box-blank comprising:

a first end, a second end, and a longitude having a direction from the first end toward the second end;

a top segment, a bottom segment and side segments, which top-, bottom-, and side segments remain substantially flat in both the folded and the unfolded form of the box-blank;

a plurality of primary folding lines serving to allow an operator to form the box from the box-blank by folding the flat segments around respective primary folding lines;

a plurality of latent destructive lines on at least part of at least one flat segment selected from the group consisting of the top segment and the bottom segment, the latent destructive lines having a direction substantially perpendicular to the longitudinal direction of the box-blank, and an effective degree of higher resistance to folding than the primary folding lines, so that they present no interference with the formation of the box, and the flatness of the flat segments before and after the box formation; and allow irreversible destruction of the box by the operator through first unfolding the box to its box-blank configuration and then folding the box-blank around the latent destructive lines to form a log-like structure.

Furthermore, this invention pertains a foldable box comprising:

a first end, a second end, and a longitude having a direction from the first end toward the second end;

an inside skin portion between the two ends;

an outside skin portion opposite the inside skin portion;

a middle portion comprising corrugations, the corrugations having a direction parallel to the direction of the longitude, the middle portion having a thickness and being sandwiched between the inside skin portion and the outside skin portion;

segments which remain substantially flat in both a folded and unfolded form of the box;

a plurality of primary folding lines serving to form the box by folding the flat segments around said primary folding lines;

a plurality of latent score lines on at least a part of the flat segments, the latent score lines originating at the inside skin portion, extending partly through the middle portion, and having a direction substantially perpendicular to the longitudinal direction of the box, the latent score lines having an effective degree of higher resistance to folding than the primary folding lines, so that they present no interference with the formation and function of the box; and facilitate irreversible destruction of at least some of the flat segments of the box after the function of the box has been ceased, the destruction being caused by propagation of the majority of the latent score lines toward the outside skin portion of the box, when the box is folded from the first end toward the second end in a manner that the box forms a log-like structure with at least part of the inside skin portion of the box becoming an exterior of the log-like structure.

Also in the case of this embodiment, the latent score lines may exist only at one end of the box. The intervals between the latent destructive lines are preferably in the range of 1 to 10 cm. Also preferably, the latent score lines extend less than 20% through the thickness of the middle portion, thickness of the inside and the outside skin portions are independently in the range of 0.1 to 1 mm, while the thickness of the corrugations is in the range of 0.5 to 5 mm.

4. DESCRIPTION OF THE DRAWING

The reader's understanding of the present invention will be enhanced by reference to the following detailed description taken in conjunction with the drawing figures, wherein.

5. DETAILED DESCRIPTION OF THE INVENTION

Figure 1:
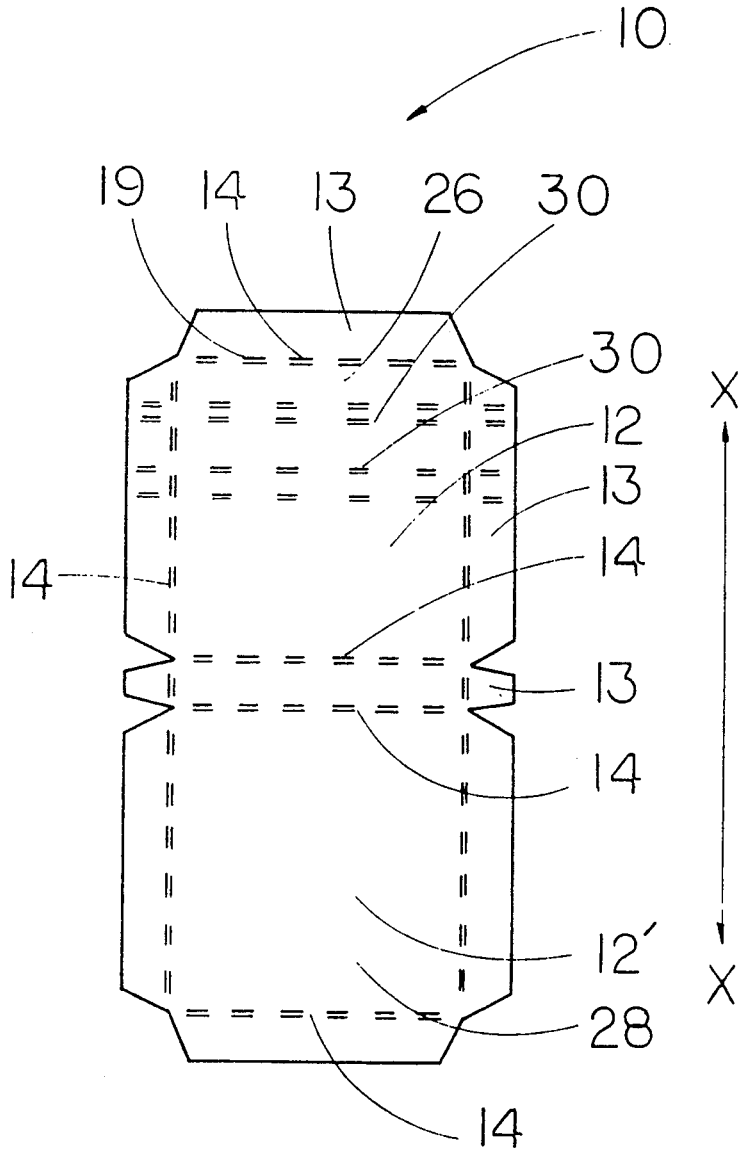
FIG. 1 is a schematic diagram showing a box in an unfolded mode, or a box-blank, according to a preferred embodiment of the present invention.

The instant invention is directed to foldable boxes, and more particularly to boxes which may be easily disposed of by destructive folding, preferably to form a log-shaped configuration.

It is important at this point to define certain terms used to describe this invention. By "foldable box" it is meant a box which takes its shape by folding different sections of a "box-blank", or in other words a blank piece of flat material, such as cardboard for example, around folding lines, called "primary folding lines" in this discussion. This action is also called "formation" of the box. "Unfolded box" or "Unfolded box-blank" have the same meaning and they refer to a blank piece of flat material as mentioned above. In the same manner, "folded box" and "folded box-blank" have also the same meaning and they refer to the shaped article after folding the miscellaneous segments around the "primary folding lines". The primary folding lines may include indentations, miscellaneous cuts, through-cut slits, perforations, scores, and the like. For all practical purposes, the term "perforation" includes miscellaneous types of through-cuts and through-cut slits. The primary folding lines have a maximum possible degree of weakening the box at their location, so that an operator may perform the folding as fast and as easily as possible, with a minimum chance of misfolding the box in the wrong place. Thus, the box may be folded, unfolded, and re-folded at will many times around the "primary folding lines" without any substantial loss of its final integrity as a folded or formed box. Score lines may also be used for this purpose, mainly on the outside surface of the unfolded box or blank, so that segments of the box may be bent and folded over the length of the score lines, which then serve as "primary folding lines". However, these score lines are purposely designed to be as wide and deep as possible in order to yield to a folding or bending force, usually toward the inside of the box, as easily as possible, for the same reasons described above. It is a strict requirement of this invention that another type of lines which are perpendicular to the longitude of the box-blank and parallel to each other, as explained hereinbelow, called "Latent Destructive Lines", have higher resistance to folding than primary Folding lines. "Latent score lines" are a specific type of Latent Destructive Lines. As their name denotes, they are score lines which also have higher resistance to yielding to folding or bending forces than "Primary Folding Lines". It is essential for the purposes of the present invention that once the Latent Destructive Lines, or the Latent Score Lines have yielded, they bring about permanent destruction or damage to the integrity of the Folded or Unfolded box or box-blank as defined above. One can control the degree of resistance to yielding to folding or bending forces by varying the width, the depth, and the frequency of indentations and scores, or the dimensions and frequency of perforations as explained later in detail. The wider, the deeper and more frequent the indentations and the scores, as well as the larger the dimensions and the more frequent the perforations the more easily the lines will yield to folding or bending forces. Thus, it is very easy for a person of ordinary skill in the art to determine with very little experimentation a degree of resistance so that the latent destructive lines will not yield or present interference with the formation of the box. At the same time, after the useful life or function of the box has been ceased, an operator may destructively fold the box from one end toward the other end in a manner that the box forms a log-like structure.

Referring now to FIG. 1, there is depicted a box-blank 10 in an unfolded mode, according to a preferred embodiment of this invention. It may be made of any suitable material for the construction of boxes, such as for example paper, coated paper, plastic, and the like.

The box-blank 10 has a number of flat segments, including a top segment 12, a bottom segment 12', and side segments 13, all of which remain substantially flat in both the unfolded (box-blank) and the folded form (box. not shown). The box-blank has also a plurality of primary folding lines 14 serving to form the box by folding the flat segments 12, 12', and 13 around the respective primary folding lines 14. In the present state of the art, the primary folding lines include indentations, perforations, through-cut slits, scores, and the like in order to form improved boxes having other than square dimensions, such as for example hexagonal, octagonal, and the like.

Figure 2:
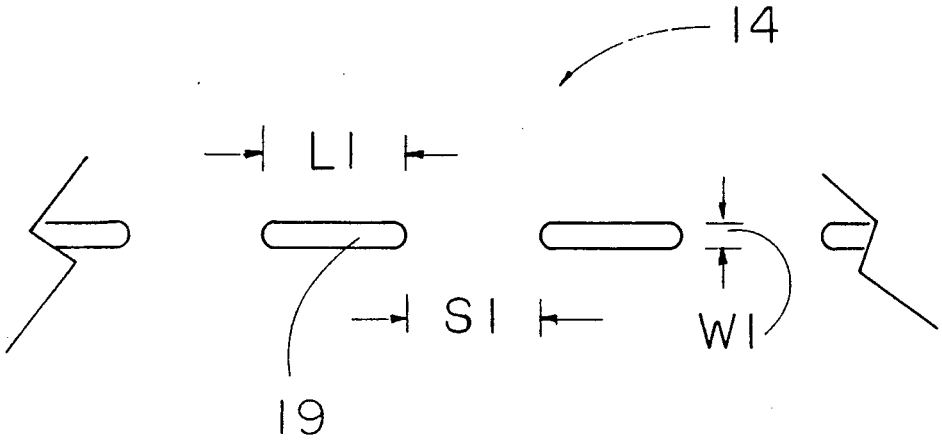
FIG. 2 is a schematic magnified fractional top view of a primary folding line having fragments in the form of perforations, according to the embodiment depicted in FIG. 1.

In the embodiment of FIG. 1, the primary folding lines comprise fragments 19 in the form of perforations, better shown in FIG. 2. Of course, fragments may be in other forms, such as indentations, scores, and the like, or combinations thereof. Regarding resistance to folding of segments 12, 12' and 13 around the respective primary fold lines, the fragments 19 are characterized by a first length L1, and a first separation or distance between consecutive fragments S1. The larger the first separation S1 and the smaller the first length L1 the higher the resistance to folding. Thus, the ratio S1/L1 of the first separation S1 to the first length L1 is an excellent measure of resistance to folding the segments around the primary folding lines 14. The higher the ratio, the higher the resistance. Although in the embodiment of FIGS. 1 and 2 all fragments have the same first length L1 and the same separation S1, other configurations are also possible, where within a primary folding line 14 different fragments may have different lengths and separations. In such a case, the arithmetic average length and the arithmetic average separation should be considered as first length and first separation, respectively. In the case of the embodiment shown in FIGS. 1 and 2, the ratio of the first separation to the first length is 1. Values in the vicinity of ratio 1 are used extensively in the field, especially in the case of corrugated boxes.

Although the width of the fragment also plays a role in the resistance to folding, in most occasions it is less important than the aforementioned ratio, as far as perforations are concerned. Nevertheless, it may also be used to influence the resistance to folding, especially in the case of indentations and scores. Usually, the larger the width W1, the smaller the resistance to folding. Furthermore, in the case of scores and indentations, the depth (not shown) may become very important, as well as the placement of the line on the inside or the outside portion of the box or box-blank, as it will be seen later in a different embodiment of this invention. It is also worth noting that in the case of indentations or scores, a continuous line may also be used, in which case the ratio of the first separation to first length assumes the value of infinite. The resistance to folding is then dependent mainly on the width W1 and the depth of the indentation or score.

The box-blank also has a first end 26, a second end 28, and a longitude of a direction X—X from the first end toward the second end or vice versa.

A requirement of this invention is the presence of a plurality of latent destructive lines 30 on at least a part of one of the flat segments 12 and 12'. Lines 30 have a direction substantially perpendicular to the longitudinal direction X—X of the box 10, and thus parallel to each other. The latent destructive lines 30 are made to have an effective degree of higher resistance than the primary folding lines, so that they present no interference with the formation and function of the box 10. Thus, the box may be formed by folding the flat segments 12 and 13 around the folding lines 14 without disturbing the latent destructive lines 30, and therefore without affecting the rigidity and integrity of the box 10. It is equally important, however, that the degree of resistance of the latent lines to folding is not excessive and that the latent destructive lines may yield when a reasonably high force is applied by an operator to fold the box from one end to the other end. In other words, after the useful life of the box has been ceased, for example after a pizza contained in the box has been consumed, the latent destructive lines 30 should facilitate irreversible destruction of at least some of the flat segments of the box, in a manner that the box 10 forms a log-like structure. The log-like structure may be disposed of easily. For example, it may be recycled, be burned in a fire place, or serve as a fire-starter.

Figure 3:
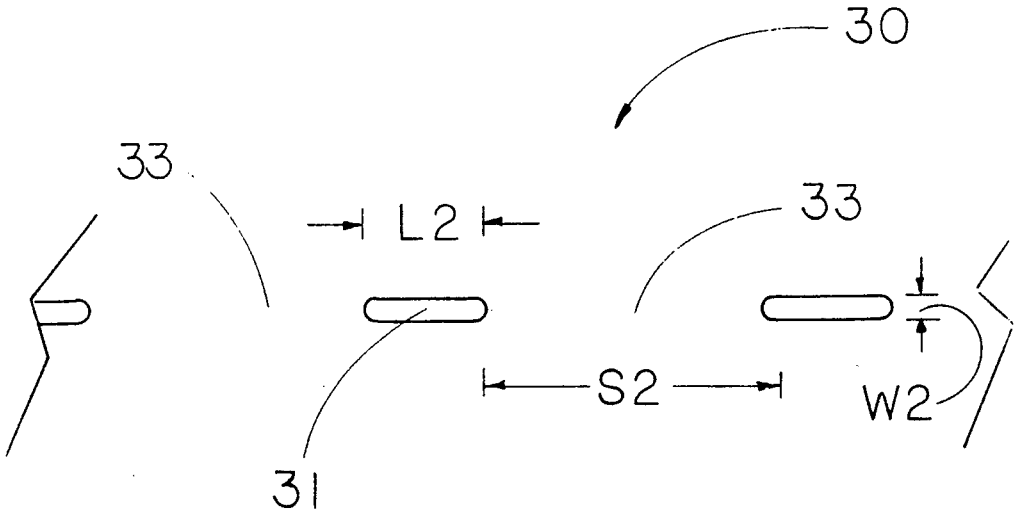
FIG. 3 is a schematic magnified fractional top view of a latent destructive line having fragments in the form of perforations, according to the embodiment depicted in FIG. 1.

As in the case of the primary folding lines 14, the latent destructive lines 30 may comprise fragments in the form of perforations 31, better shown in FIG. 3, which fragments are also characterized by a second separation S2 and a second length L2, providing a ratio S2/L2. The same general comments regarding S1, L1, and Sl/L1, apply here also. Since it is a strict requirement of this invention that the latent destructive lines present higher resistance to folding than the primary folding lines, it is very important that S2/L2 is larger than S1/L1, provided that the other characteristics of the two types of lines are similar. A difference of at least 20%, preferably at least 50%, and even more preferably at least 100% is appropriate. In the embodiment depicted in FIGS. 1, 2, and 3, S2/L2=2, while S1/L1=1, which corresponds to a difference of 100%. If S2/L2 is less than about 20% larger than S1/L1, some of the latent destructive lines 30 may be folded and broken accidently during formation of the box, which formation involves folding the different segments 12, 12', and 13 of the box-blank 10 around the primary folding lines 14. By breaking the line, it is meant that an irreversible weakening of the box integrity will occur over substantially the whole length of the line. Before any folding around some line 30, the interstitial sections 33 connect rigidly the portions of the respective segment around said line. However, after folding occurs, the rigidity of the interstitial sections 33 is irreversibly destroyed, and any new folding around the affected line is confronted by only minimal resistance, thus permanently deteriorating the rigidity of the box itself. In addition, the flatness of the segment involved is also permanently destroyed after the first folding of any latent destructive line.

The latent destructive lines may be located in equal intervals from each other, or they may be separated by progressively higher intervals. Also the intervals may be arranged in two intermixed sets of short and long intervals, both of which are progressively becoming larger, moving from one end 26 to the other end 28 of the box-blank, as shown in the embodiment of FIG. 1. The long and the short intervals are alternating in a manner to form a log structure having a somewhat rectangular cross-section. Although the latent destructive lines may be present throughout the box-blank, usually 3–4 latent destructive lines in the vicinity of one end of the box-blank, as shown in FIG. 1, are adequate to form a strong enough preliminary log around which the rest of the box may be folded or wound. Thus, after initial destructive folding, a preliminary (not shown) but sturdy enough log-structure is formed to support the remainder of the destructive folding in the absence of more latent destructive lines at the remainder of the box. Of course, in this particular case, the overall structure of the box should be adequately weak to permit such an arrangement. The intervals should preferably be in the range of 1–10 cm.

For the purposes of this invention, at least the top 12 and bottom 12' segments should be monolithic. In general, the severity of the problem that this invention solves is highest when the foldable box is totally monolithic. However, it also applies to boxes comprising more than one pieces. Preferably the top and bottom segments should have substantially equal surface areas. It is also preferable that the surface area of the top segment is at least three times as large as the surface area of the largest-in-area side segment. This invention is more applicable and more useful in the case that the box has large top and bottom as compared to the sides. This invention is particularly applicable to boxes utilized to contain pizzas, or boxes of similar dimensions, since the top/bottom flat segments 12 and 12' are very large as compared to the side flat segments 13, and they are required to be sturdy.

The box-blank may also comprise corrugations having preferably a direction parallel to the direction X—X of the longitude of the box-blank. The corrugations, which are desirable for rigidity and many times for thermal insulation, as well as other desirable properties, are difficult to fold against their orientation. The presence of latent destructive lines provides an outstanding solution in retaining the rigidity of the corrugations when needed during box formation and use, but it also provides effective and convenient means for destruction when also needed for disposal of the box.

Figure 4:
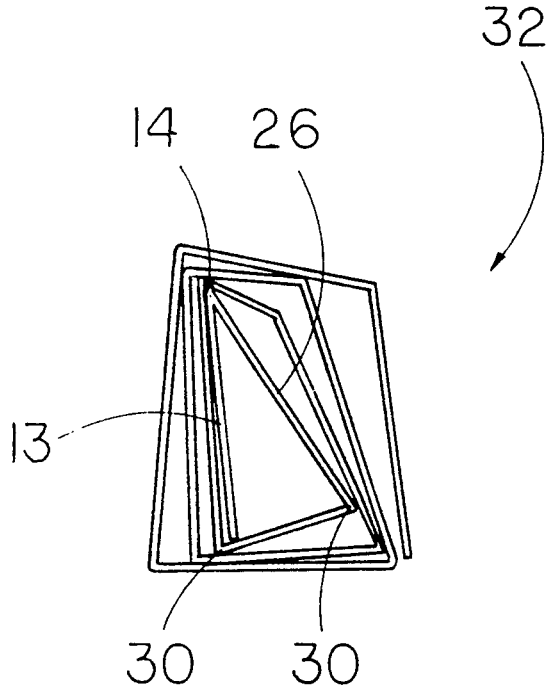
FIG. 4 is a schematic diagram showing a cross section of the unfolded box of FIG. 1, after the box has been unfolded to the form of the box-blank, and then destructively folded to form a log-like structure.

In operation, the box-blank 10, as shown in FIG. 1, is used to form the final box (not shown) by folding inward the flat side-segments 13 around primary folding lines 14. In sequence, an item (not shown) is placed on one of the top/bottom flat segments 12, followed by closing the box by folding the remaining top/bottom flat segments 12 and 12', around the respective primary folding lines 14, on top of the item. Since the latent destructive lines possess an adequately higher degree of folding or bending as compared to the primary folding lines, they remain intact during these steps. Also, the latent destructive lines remain intact during handling, transferring, etc., the box with the enclosed item. At a later time, the box is opened by unfolding the box at least partially, in a reverse sequence from the one described above, so that the item is removed and used, for consumption for example, if it is a pizza for example. In order to discard the box, the box is completely unfolded to the form of the box-blank 10 as depicted in FIG. 1. Starting at the first end 26, the box is then folded, using higher force of folding than the one required for the formation of the box to bend and fold the portions of the unfolded box around the latent destructive lines 30. This type of destructive folding is continued until a final log-like structure 32, better shown in FIG. 4, ready for disposal is formed.

Another embodiment of this invention is illustrated in FIGS. 5–8. Referring to FIGS. 5–8, there is depicted a box blank or an unfolded box 110. The box 110 has a number of segments 112, which remain substantially flat in both the unfolded and the folded form (not shown)of the box. The box-blank has also a plurality of primary folding lines 114 serving to form the box by folding the flat segments 112 around the primary folding lines 114. The configuration of the primary folding lines 114 is similar to the folding lines of the embodiment shown in FIGS. 1-4. In the present state of the art, these folding lines include indentations, through-cut slits, and the like in order to form improved boxes having other than square dimensions, such as for example hexagonal, octagonal, and the like.

Figure 6:
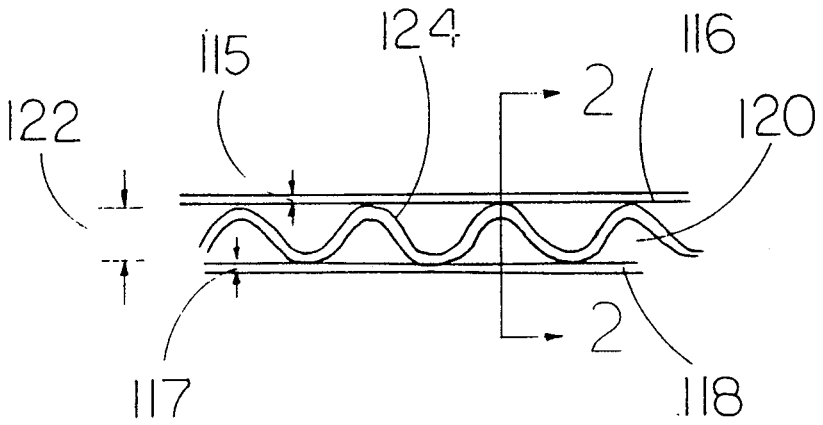
FIG. 6 illustrates a magnified fragmental cross-sectional elevation across line 1—1 of the embodiment illustrated in FIG. 1.
Figure 7:
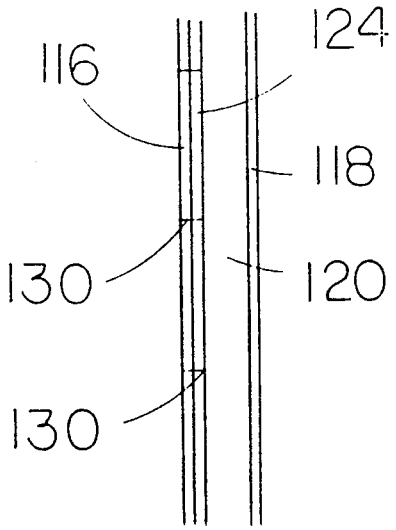
FIG. 7 is a schematic diagram showing a magnified fragmental cross sectional elevation across line 2—2 of the embodiment illustrated in FIGS. 5 and 6.
Figure 8:
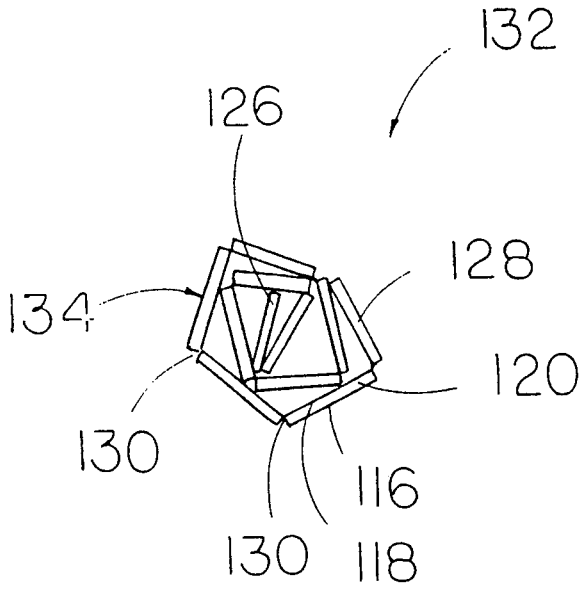
FIG. 8 is a schematic diagram showing a cross section of the unfolded box of FIG. 5, after the box has been unfolded to the form of the box-blank, and then destructively folded to form a log-like structure.

The box-blank further has an inside skin portion 116, an outside skin portion 118 opposite the inside skin portion 116, and a middle portion 120 comprising corrugations 124, having a thickness 122 and being sandwiched between the inside skin portion 116 and the outside skin portion 118, as better shown in FIG. 6. It is preferred that the thicknesses 115 and 117 of the inside and the outside skin portions 116 and 118, respectively, are independently in the range of 0.1 to 1 mm, while the thickness 122 of the middle portion 120 is in the range of 0.5 to 5 mm. The corrugations 124 are substantially parallel to the longitudinal direction X'—X' of the box 110.

The skin and middle portions may be made of any suitable material for the construction of boxes, such as for example paper, coated paper, plastic, and the like.

The box also has a first end 126, a second end 128, and a longitude of a direction X'—X' (as already mentioned) from the first end toward the second end or vice versa.

An essential feature of this invention is the presence of a plurality of latent score lines 130 on at least a part of the flat segments 112. The latent score lines 130, which are a special type of latent destructive lines, originate at the inside skin portion 116, and extend partly through the middle portion 120. Lines 130 have a direction substantially perpendicular to the longitudinal direction X'—X' of the box 110. The latent score lines 130 are made to have an effective degree of higher resistance than the primary folding lines, so that they present no interference with the formation and function of the box 110. Thus, the box may be formed by folding the flat segments 112 and 113 around the folding lines 114 without disturbing or opening the latent score lines 130, and therefore without affecting the rigidity and integrity of the box-blank 110, or the box (not shown) made from the box-blank 110. It is equally important, however, that the degree of resistance of the latent lines to folding is not excessive and that the latent score lines may yield when a reasonably high force is applied by an operator to fold the box from one end to the other end. In other words, after the useful life of the box has been ceased, for example after a pizza contained in the box has been consumed, the latent score lines 130 should facilitate irreversible destruction of at least some of the flat segments of the box, the destruction caused by propagation of the majority of the latent score lines 130 through the corrugations 124 and toward the outside skin portion 118 of the box-blank 110, when the box-blank 110 is folded from the first end 126 toward the second end 128 in a manner that it forms a log-like structure 132 as better shown in FIG. 8, with at least part of the inside skin portion 116 of the box-blank 110 becoming an exterior 134 of the log-like structure 132. The log-like structure may be disposed of easily, it may be recycled ,or even be burned in a fire place as a fire-starter.

As aforementioned, it is important for the corrugations 124 to be substantially parallel to the longitudinal direction X'—X' of the box 110, and for the latent score lines 130 to be substantially perpendicular to the same direction. It is also important that the latent score lines originate on the inside portion 116 of the box-blank and not on the outside portion 118, in order to provide proper balance of degree of resistance to folding, when compared to primary folding lines. It is further important to note that substitution of latent score lines as defined herein, with lines having the properties of primary folding lines result in unacceptable rigidity and performance of boxes.

Also, as mentioned before, the thickness 122 of the middle portion 120 which contains the corrugations 124 is preferably in the range of 0.5 to 5 mm.

Figure 5:
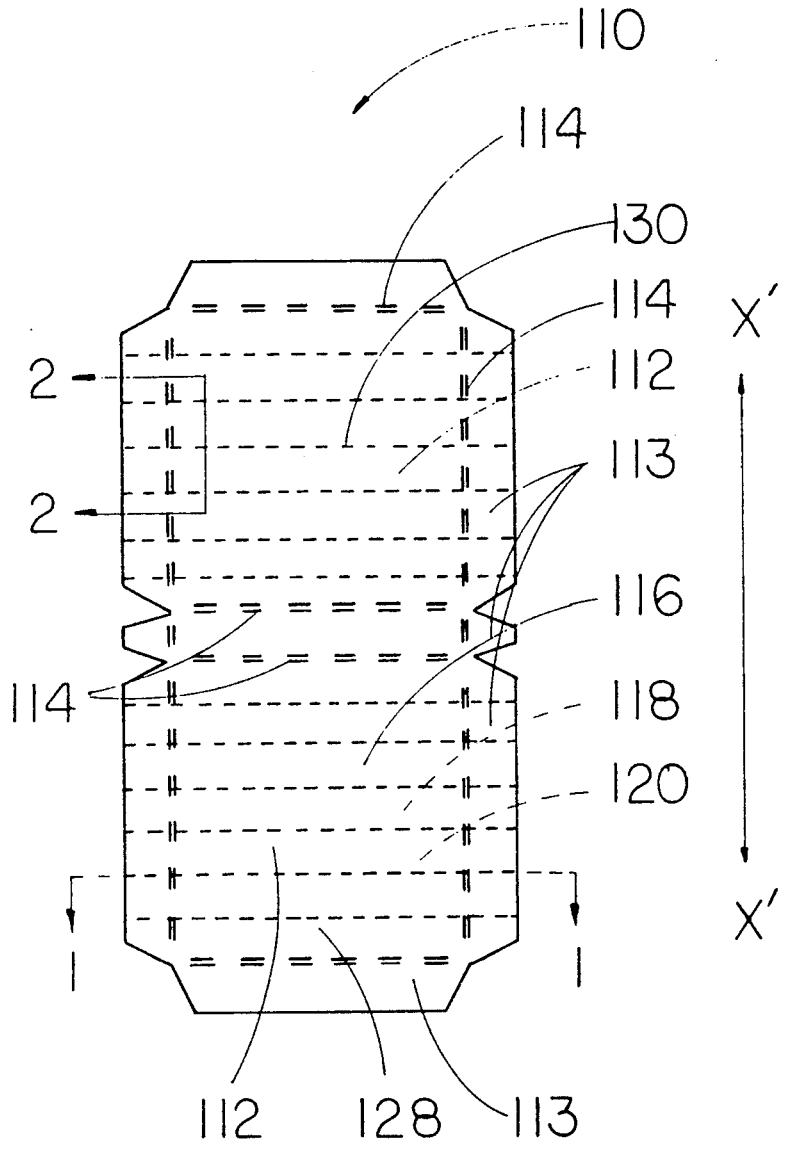
FIG. 5 is a schematic diagram showing a box in an unfolded mode, or a box-blank, according to a different embodiment of the present invention.

The latent score lines 130 may be located at substantially equal intervals as shown in FIG. 5, preferably in the range of 0.5 to 5 cm. They may also be located at increasingly wider intervals (not shown) along the longitude, preferably in the range of 1 to 10 cm, and more preferably in the range of 2 to 7 cm, to compensate for the increasing thickness of the log-like structure 132 as the folding from the first end 126 to the second end 128 is proceeding. Furthermore, the latent score lines 130 may also be arranged in sets of intervals (not shown), each set having substantially equidistant intervals, the intervals increasing from set to set along the longitude in a similar manner and for the same reason as in the previous case. In this case also, the intervals between the latent score lines are preferably in the range of 1 to 10 cm. It is also possible to have latent score lines only at one end of the box, so that after initial destructive folding, a preliminary (not shown) but sturdy enough log-structure has been formed to support the remainder of the destructive folding in the absence of more latent score lines at the remainder of the box. Of course, in this particular case, the sandwich structure of the box should be adequately weak to permit such an arrangement. Furthermore the intervals may be arranged in two intermixed sets of short and long intervals, both of which are progressively becoming larger, moving from one end 126 to the other end 128 of the box-blank. In this case, the long and the short intervals may be alternating in a manner to form a log structure having a somewhat rectangular cross-section.

The corrugations, which are desirable for rigidity and many times for thermal insulation, as well as other desirable properties are difficult to fold against their orientation. The presence of latent score lines provides an outstanding solution in retaining the rigidity of the corrugations when needed during box formation and use, but it also provides effective and convenient means for destruction when also needed for disposal of the box.

The latent score lines should preferably extend less than 50% through the thickness of the middle portion 120, more preferably less than 20%, and even more preferably less than 10%. A small extension of the latent score lines beyond the inside skin portion 116 to only 1-5% of the thickness of the middle portion 120 gives satisfactory results. No exact figures may be given, since they depend on the nature of materials used for the construction of the different portions of the box.

It is preferred that the thickness of the inside and the outside skin portions are independently in the range of 0.1 to 1 mm.

In operation, the box-blank or unfolded box 110, as exemplified in FIG. 5, is formed by folding inward the flat side-segments 113 around primary folding lines 114. In sequence, an item (not shown) is placed on one of the top/bottom flat segments 112, followed by closing the box by folding the remaining top/bottom flat segment 112, around the respective primary folding lines 114, on top of the item. Since the latent score lines possess an adequately higher degree of folding or bending as compared to the primary folding lines, they remain intact during these steps. Also, the latent score lines remain intact during handling, transferring, etc., the box with the enclosed item. At a later time, the box is opened by unfolding the box at least partially, in a reverse sequence from the one described above, so that the item is removed and used, for consumption for example, if it is a pizza for example. In order to discard the box, the box is completely unfolded in a mode as the one depicted in FIG. 5. Starting at the first end 126, the box is then folded, using higher force of folding than the one required for the formation of the box, in a manner that the inside portion 116 remains on the outside of the folding. Due to the higher folding or bending forces applied, the latent score lines 130 start yielding and they propagate through the thickness 122 of the inside portion 120 which contains the corrugations 124, toward the outside portion 118, thus facilitating the folding and providing an orderly bending with substantially straight destructive scores as better illustrated in FIG. 8. This type of destructive folding is continued until a final log-like structure 32, ready for disposal is formed.

It should be understood that examples demonstrating the construction, features, and operation of the instant invention have been given for illustration purposes only, and should not be construed as restricting the scope or limits of this invention in any way.

What is claimed is:

1. A foldable box-blank comprising:

a first end, a second end, and a longitude having a direction from the first and toward the second end;

a top segment, a bottom segment and side segments, said top segment, said bottom segment, and said side segments remaining substantially flat in both a folded and unfolded form of the box-blank;

a plurality of primary folding lines serving to allow an operator to form a box from the box-blank by folding the flat segments around said primary folding lines;

a plurality of latent destructive lines on at least part of at least one flat segment selected from a group consisting of the top segment and the bottom segment, the latent destructive lines having a direction substantially perpendicular to the longitudinal direction of the box-blank, and an effective degree of higher resistance to folding than the primary folding lines, so that they present no interference with the formation of the box, and the flatness of the flat segments before and after the box formation; and allow irreversible destruction of the box by the operator through first unfolding the box to its box-blank configuration and then folding the box-blank around the latent destructive lines to form a log-like structure, with the requirement that the resistance to folding of the latent destructive lines is at least 20% higher than the resistance to folding of the primary folding lines.

2. A box-blank as defined in claim 1, wherein said latent destructive lines are between 1 and 10 cm apart from each other.

3. A box-blank as defined in claim 2, wherein the latent destructive lines are located in at least one of said ends.

4. A box-blank as defined in claim 3, wherein there are only 4 of said latent destructive lines.

5. A box-blank as defined in claim 1, wherein each of the folding lines and each of the latent destructive lines independently comprise consecutive fragments selected from a group comprising perforations, indentations, scores, and a combination thereof.

6. A box-blank as defined in claim 5, wherein the fragments of the folding lines are characterized by a first length and a first separation; and the fragments of the latent destructive lines are characterized by a second length and a second separation; and wherein the second separation divided by the second length is at least 20% larger than the first separation divided by the first length.

7. A box-blank as defined in claim 6, wherein the fragments are perforations.

8. A box-blank as defined in claim 1, wherein the top and the bottom segments are monolithic.

9. A box-blank as defined in claim 8, wherein the top segment and the bottom segment have substantially equal surface areas.

10. A box-blank as defined in claim 9, wherein the top segment is at least three times as large as any of said side segments.

11. A box-blank as defined in claim 1, further comprising corrugations having a direction parallel to the direction of the longitude of the box-blank.

12. A box made from a box blank, the box-blank comprising:

a first end, a second end, and a longitude having a direction from the first end toward the second end;

a top segment, a bottom segment and side segments, said top segment, said bottom segment, and said side segments remaining substantially flat in both a folded and unfolded form of the box-blank;

a plurality of primary folding lines serving to allow an operator to form the box from the box-blank by folding the flat segments around said primary folding lines;

a plurality of latent destructive lines on at least part of at least one flat segment selected from a group consisting of the top segment and the bottom segment, the latent destructive lines having a direction substantially perpendicular to the longitudinal direction of the box-blank, and an effective degree of higher resistance to folding than the primary folding lines, so that they present no interference with the formation of the box, and the flatness of the flat segments before and after the box formation; and allow irreversible destruction of the box by the operator through first unfolding the box to its box-blank configuration and then folding the box-blank around the latent destructive lines to form a log-like structure, with the requirement that the resistance to folding of the latent destructive lines is at least 20% higher than the resistance to folding of the primary folding lines.

13. An assembly of a foldable box and an item contained within the foldable box, the foldable box made from a box-blank, the box blank comprising:

a first end, a second end, and a longitude having a direction from the first end toward the second end;

a top segment, a bottom segment and side segments, said top segment, said bottom segment, and said side segments remaining substantially flat in both a folded and unfolded form of the box-blank;

a plurality of primary folding lines serving to allow an operator to form the box from the box-blank by folding the flat segments around said primary folding lines;

a plurality of latent destructive lines on at least part of at least one flat segment selected from a group consisting of the top segment and the bottom segment, the latent destructive lines having a direction substantially perpendicular to the longitudinal direction of the box-blank, and an effective degree of higher resistance to folding than the primary folding lines, so that they present no interference with the formation of the box, and the flatness of the flat segments before and after the box formation; and allow irreversible destruction of the box by the operator through first unfolding the box to its box-blank configuration and then folding the box-blank around the latent destructive lines to form a log-like structure, with the requirement that the resistance to folding of the latent destructive lines is at least 20% higher than the resistance to folding of the primary folding lines.

14. A box as defined in claim 13, wherein the item contained in the foldable box is a pizza.

* * * * *